US007931512B2

(12) United States Patent
Bortsov et al.

(10) Patent No.: US 7,931,512 B2
(45) Date of Patent: Apr. 26, 2011

(54) MANUALLY OPERATED WATERCRAFT

(75) Inventors: Peter Bortsov, Dollard des Ormeaux (CA); Alexandre Prisheltsev, Lachine (CA)

(73) Assignee: IT Creations Corporations, Montreal (CA)

( * ) Notice: Subject to any disclaimer, the term of this patent is extended or adjusted under 35 U.S.C. 154(b) by 0 days.

(21) Appl. No.: 12/470,992

(22) Filed: May 22, 2009

(65) Prior Publication Data

US 2010/0075550 A1 Mar. 25, 2010

Related U.S. Application Data

(63) Continuation of application No. PCT/CA2007/002120, filed on Nov. 22, 2007.

(60) Provisional application No. 60/866,977, filed on Nov. 22, 2006.

(51) Int. Cl.
*B63H 16/20* (2006.01)

(52) U.S. Cl. ..... 440/30

(58) Field of Classification Search ..... 440/11, 440/12, 21, 26, 29, 30, 31; 114/343
See application file for complete search history.

(56) References Cited

U.S. PATENT DOCUMENTS

| | | | | |
|---|---|---|---|---|
| 4,170,188 | A * | 10/1979 | Jamison, Jr. | 440/30 |
| 4,676,755 | A | 6/1987 | Yagan | |
| 5,362,264 | A | 11/1994 | Parant | |
| 5,387,140 | A * | 2/1995 | Cunningham | 440/12 |
| 5,547,406 | A | 8/1996 | White | |
| 5,803,774 | A * | 9/1998 | White | 440/12 |

FOREIGN PATENT DOCUMENTS

| | | |
|---|---|---|
| FR | 2535284 | 4/1984 |
| WO | 2008/061374 | 5/2008 |

OTHER PUBLICATIONS

International Search Report of PCT/CA2007/002120 filed Nov. 22, 2007.

* cited by examiner

*Primary Examiner* — Daniel V Venne
(74) *Attorney, Agent, or Firm* — Ogilvy Renault LLP

(57) ABSTRACT

A personal watercraft (10) comprises a floatation platform (12) and a separate module (14) including a water propulsor driving crank mechanism (22) and a keel (38) mounting the water propulsor. The separate module (14), when mounted to the platform (12), extends at right angles to the platform with the keel (38) and propeller (40) extending below the platform (12) and the propulsor driving crank mechanism (22) extending above the platform. The separate module (14) is readily separable from the platform (12) for ease of storage and transport.

6 Claims, 7 Drawing Sheets

MANUALLY OPERATED WATERCRAFT

CROSS-REFERENCE TO RELATED APPLICATIONS

This is a continuation of International Application No. PCT/CA2007/002120 filed Nov. 22, 2007, designating the United States, which itself claims priority on U.S. provisional application No. 60/866,977 filed Nov. 22, 2006, the specifications of both of which are incorporated herein by reference.

TECHNICAL FIELD

The present invention relates to manually operated watercrafts and particularly to a watercraft that resembles a bicycle on water.

BACKGROUND

Pedal operated, propeller driven watercrafts are well known. For instance U.S. Pat. No. 5,374,206 Gregory, 1994; U.S. Pat. No. 5,405,275 Schlangen et al, 1995; U.S. Pat. No. 5,718,611 Schlangen et al, 1998; and U.S. Pat. No. 6,146,218 White, 2000 are all bicycle type watercraft having a bicycle frame mounted between a pair of pontoons or floats. U.S. Pat. No. 6,231,408 Lekhtman is also a multi-hull watercraft with a pedal and propeller mechanism integrated therein.

It has been found that such watercrafts, although acceptable, are somewhat cumbersome in transport. By definition the pontoons take up a fair area in width and the nature of the bicycle frame on the floats increases the height of the vehicle. Thus it is not easy to package, ship or to handle, once in the water or for storage on land.

SUMMARY

An embodiment of the present invention comprises a personal watercraft comprising a floatation platform, having sufficient buoyancy and lateral stability to support at least one person and a separate module including a water propulsor driving crank mechanism and a keel mounting the water propulsor; the separate module when mounted to the platform extends at right angles to the platform with the keel and propulsor extending below the platform and the propulsor driving crank mechanism extending above the platform, and the separate module being readily separable from the platform for storage and transport.

A more specific embodiment of the invention includes a watercraft comprising a floatation platform, having a bow, stern, port and starboard sides, the platform having sufficient buoyancy and lateral stability to support at least one person and a bicycle frame. The bicycle frame extends in the longitudinal axis between the bow and the stern and the bicycle frame is readily separable from the platform for storage and transport.

In a specific embodiment of the present invention the floatation platform defines an opening between the bow and stern. The bicycle frame extends in the longitudinal axis between the bow and the stern and through said opening in the platform and whereby the bicycle frame is readily separable from the platform for storage and transport.

In a more specific embodiment of the present invention the floatation platform is a first module and the bicycle frame includes a keel adapted to extend below the hull and a propeller is operably mounted abaft the keel. The bicycle frame including the keel represents a second module wherein the first and second modules are separable for transport.

More specifically the keel may house the propeller shaft and pedal-mechanism for manually driving the shaft and is integral with the remainder of the bicycle frame.

The term propulsor or water propulsor is meant to define a water propeller, paddle system or any other propulsion system capable of being driven by a manual crank mechanism.

DETAILED DESCRIPTION

Figure 1:
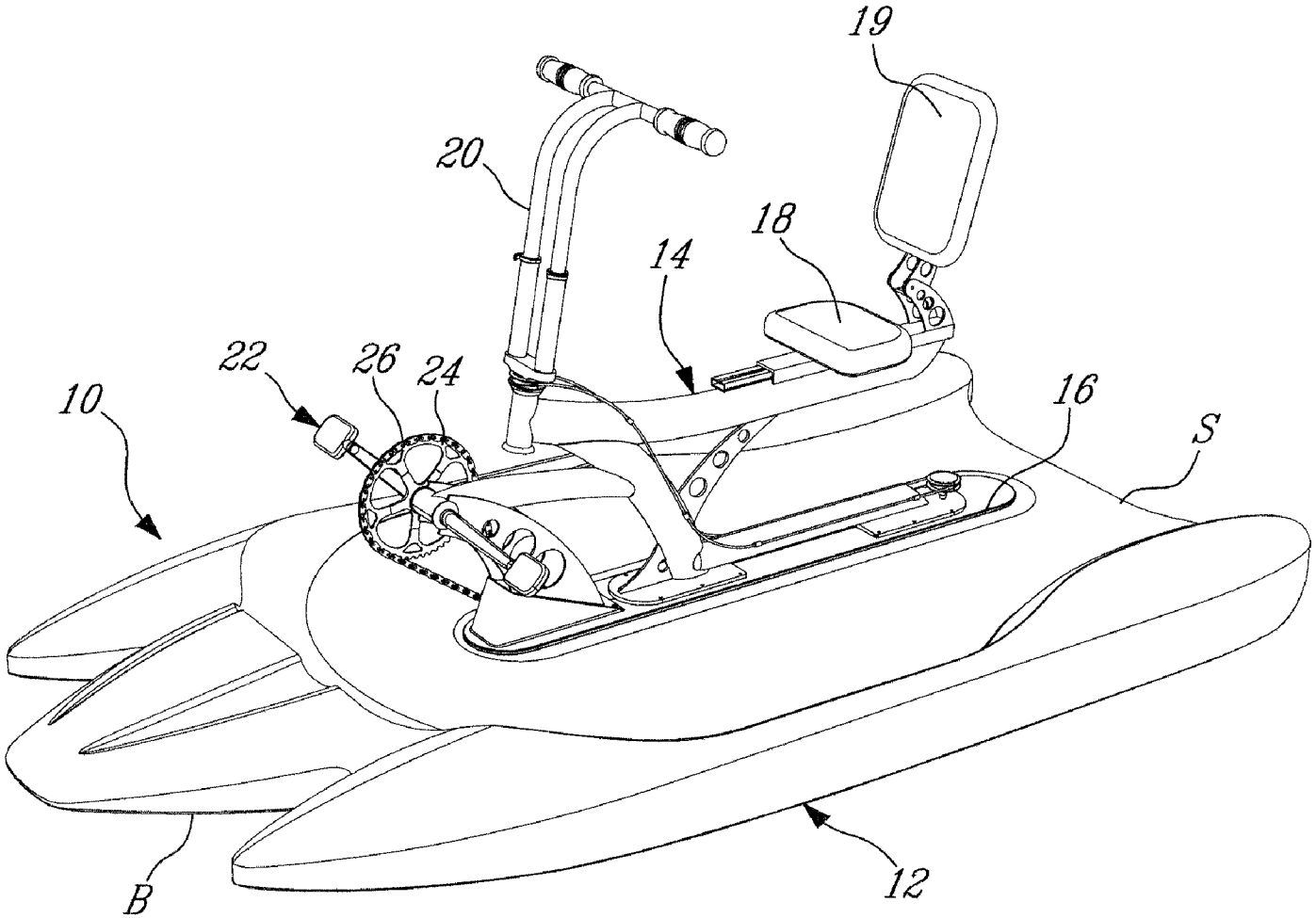
FIG. 1 is a perspective view of an embodiment of the watercraft.
Figure 2:
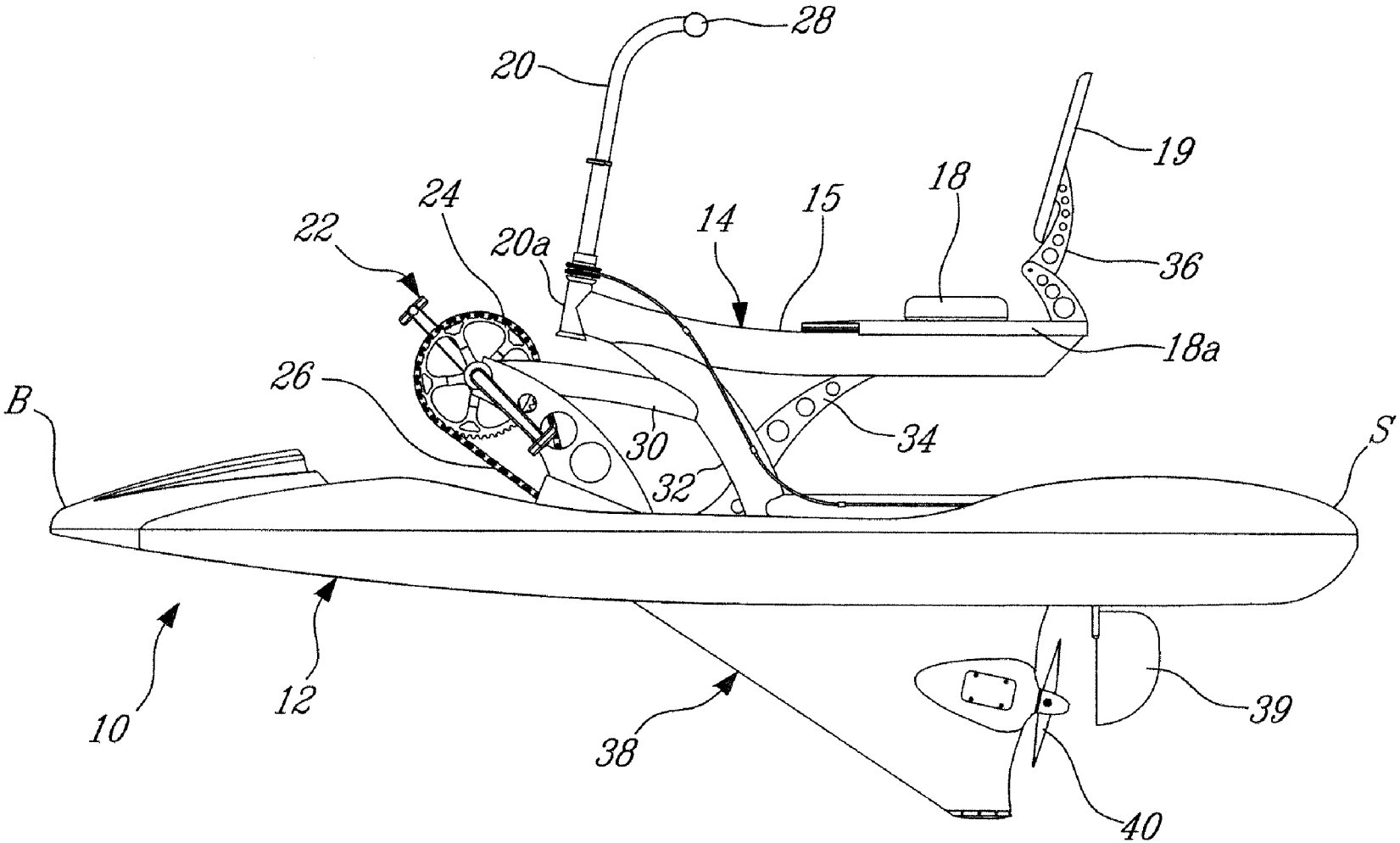
FIG. 2 is a side elevation of the watercraft shown in FIG. 1.
Figure 3:
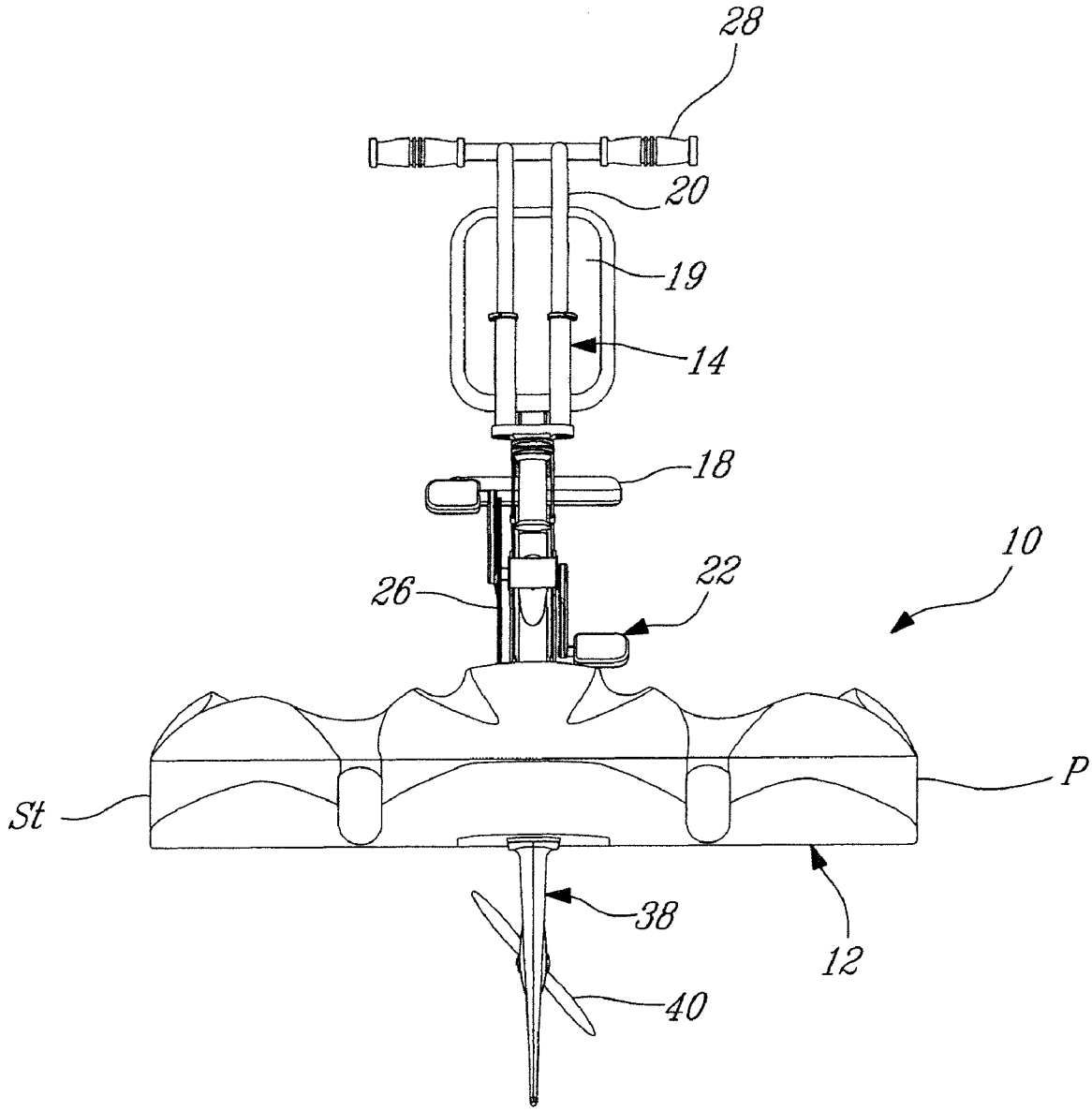
FIG. 3 is front elevation of the watercraft in accordance with FIG. 1.

Referring now to FIGS. 1 to 3 the assembled watercraft 10 includes a hull or flotation platform 12 and a bicycle frame 14 adapted to be mounted to the hull platform 12. In the depicted embodiment, the flotation platform comprises a mono-hull; however the floatation platform could also be a multi-hull such as a catamaran or trimaran.

Figure 4:
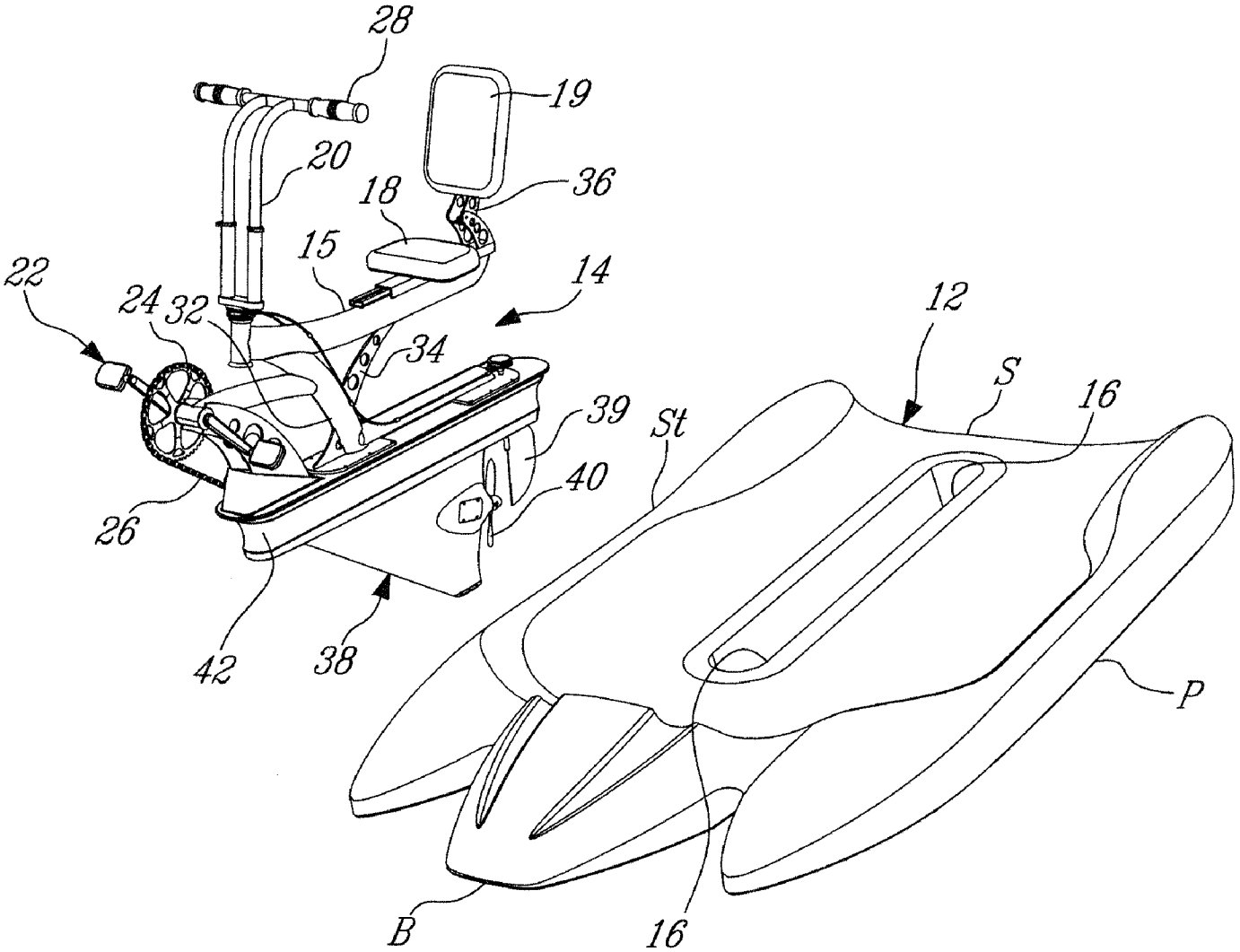
FIG. 4 is an exploded view of the watercraft of FIG. 1.

The hull 12 has a bow B, a stern S, a starboard side St and a port side P. The hull 12 includes a longitudinal slot 16 as best seen in FIG. 4. The slot 16 may have different shapes. The hull 12 is light weight, buoyant and has dimensions that are only sufficient, depending on the material used, to float while supporting a person mounted to the bicycle frame 14. The hull 12 may have larger dimensions; however the speed of travel will be compromised as the wettable area is increased. The material can be any known mouldable material used for floats, and formed by blow-moulding or by a mould known as Rotomould™. The hull could also be formed with a porous core and a fibreglass skin or other buoyant material. The material must be of sufficient structural strength to support the bicycle frame in an upright position.

The bicycle frame 14 is mounted to a beam 42 that is adapted to fit in the slot 16 of the hull 12. If the slot 16 has a different shape than the elongated slot shown in the drawings, the bicycle frame 14 and beam 42 will have a corresponding shape. The beam 42 will include fasteners (not shown) to lock the bicycle frame 14 in a fixed position to the hull 12 when assembled. The bicycle frame 14 includes a post 32 mounting a cantilevered beam 15 extending aft, above and parallel to the beam 42 as well as a tubular base member 43 attached to the beam 42. A brace 34 may be provided between the column 32 and the beam 15, as shown. A seat 18 is mounted to a carriage 18*a* that slides on track 18*c* that is fixed to the beam 15. A backrest 19 is mounted to the carriage 18*a* by means of a vertical support 36. Thus the seat 18 can slide on the beam 15 in order to adjust the position of the seat 18.

The forward portion of beam 15 mounts a bushing 20*a* that supports steering column 20 for rotation about the axis of the bushing 20*a*. A handle bar 28 is fixed to the upper reaches of the steering column 20. In the present embodiment the steering column 20 is made up of a pair of parallel tubes as shown.

Figure 7:
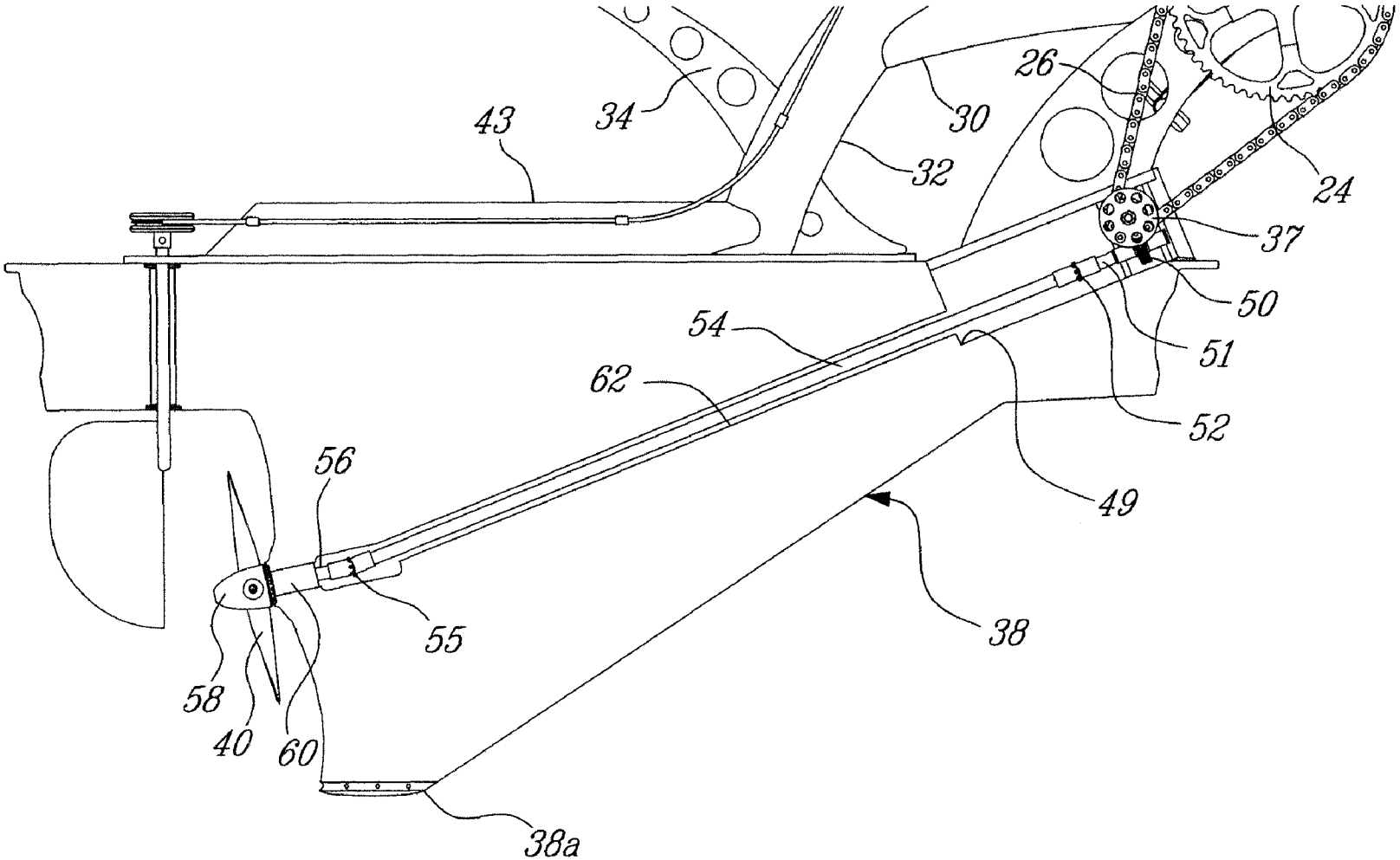
FIG. 7 is a schematic view of a gearbox, within the keel.

Referring to FIGS. 4 and 7, a further cantilevered beam 30 extends forward of the column 32 and mounts a pedal assembly 22. The frame also includes a base tube 43 for added structural support, which extends rearwardly from the column 32 and is mounted to beam 42. The pedal assembly includes a sprocket 24 and a chain 26. The chain 26 drives a sprocket 37 in the gearbox 49 formed in the keel 38. An elongated bore 62 extends within the keel from the gearbox 49 to the propeller 40. A worm and sprocket gear combination 50 is associated with the sprocket 37 to drive the shafts 51, 54 and 56. The segmented shafts 51, 54 and 56 are joined by universal joints 52 and 55. A plastic bearing 60 completes the support for the shaft. In this case the pedal assembly 22 is mounted on the upper part of the bicycle frame but it could also form part of the keel.

It is also contemplated that instead of an elongated slot, a bore could extend through the hull 12. The bicycle module could be in the form of a vertical pod mounted on a rotatable plate seated on the hull 12 over the bore. Thus the steering of the watercraft could be provided by the person operating the watercraft by simply rotating to the new direction of movement desired.

The upper part of the bicycle frame 14 may be made of lightweight metal tubing such as extruded aluminium, or other well known materials for constructing road-bicycle frames.

Figure 5:
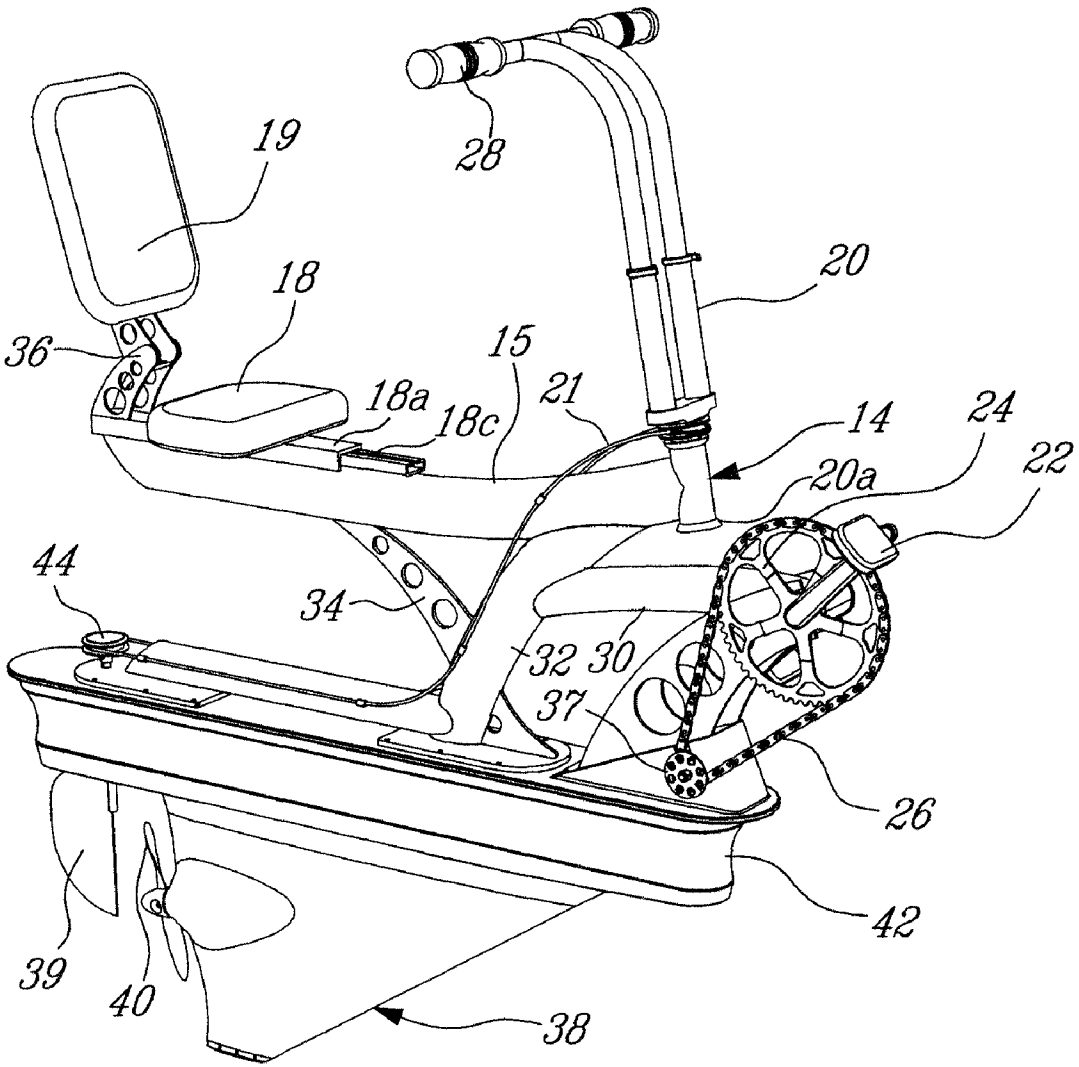
FIG. 5 is a perspective of a detail of the watercraft including the bicycle and keel.

The keel 38 is one piece with the beam 42 and is adapted to extend below the hull 12 as shown in FIG. 2. The keel 38 and beam 42 may be moulded as one-piece by thermoforming, by a Rotomould™ process or other inflatable based technology. In the present embodiment the keel 38 is moulded fibreglass. A rudder 39 is pivotally mounted to the beam 42 as shown in FIGS. 2 and 5. As shown in FIG. 5, the rudder 39 is controlled by Bowden cables 21 extending between a sprocket 42 and the steering column 20.

As can be seen in FIGS. 4 and 5 the bicycle frame 14 including the keel 38 is an integral unit. As shown in FIG. 4, the bicycle frame 14 including the keel 38 is presented as a one-piece, narrow module, which can be inserted through the slot 16 in the hull 12. During shipping, the two modules: the bicycle frame 14 and the hull 12 are packaged independently to occupy minimum volume. The two modules are easily assembled for use, by merely placing the hull 12 in shallow water and then inserting the bicycle frame 14 through the slot and fastening the beam 42 to the hull 12 when it is coincident with the slot. When it is required to transport the watercraft 10 after use, the bicycle frame 14 module is removed and stored in the luggage space of a vehicle while the hull 12 module may be strapped to the roof of the vehicle. To reduce the possibility of the propeller 40 interfering when the bicycle frame 14 module is being removed, an arrow 44 or other indicator may be located near the pedal crankshaft 22*a* to coincide with the alignment of the propeller with the keel to allow removal of the module 14 through the slot 16.

Figure 6:
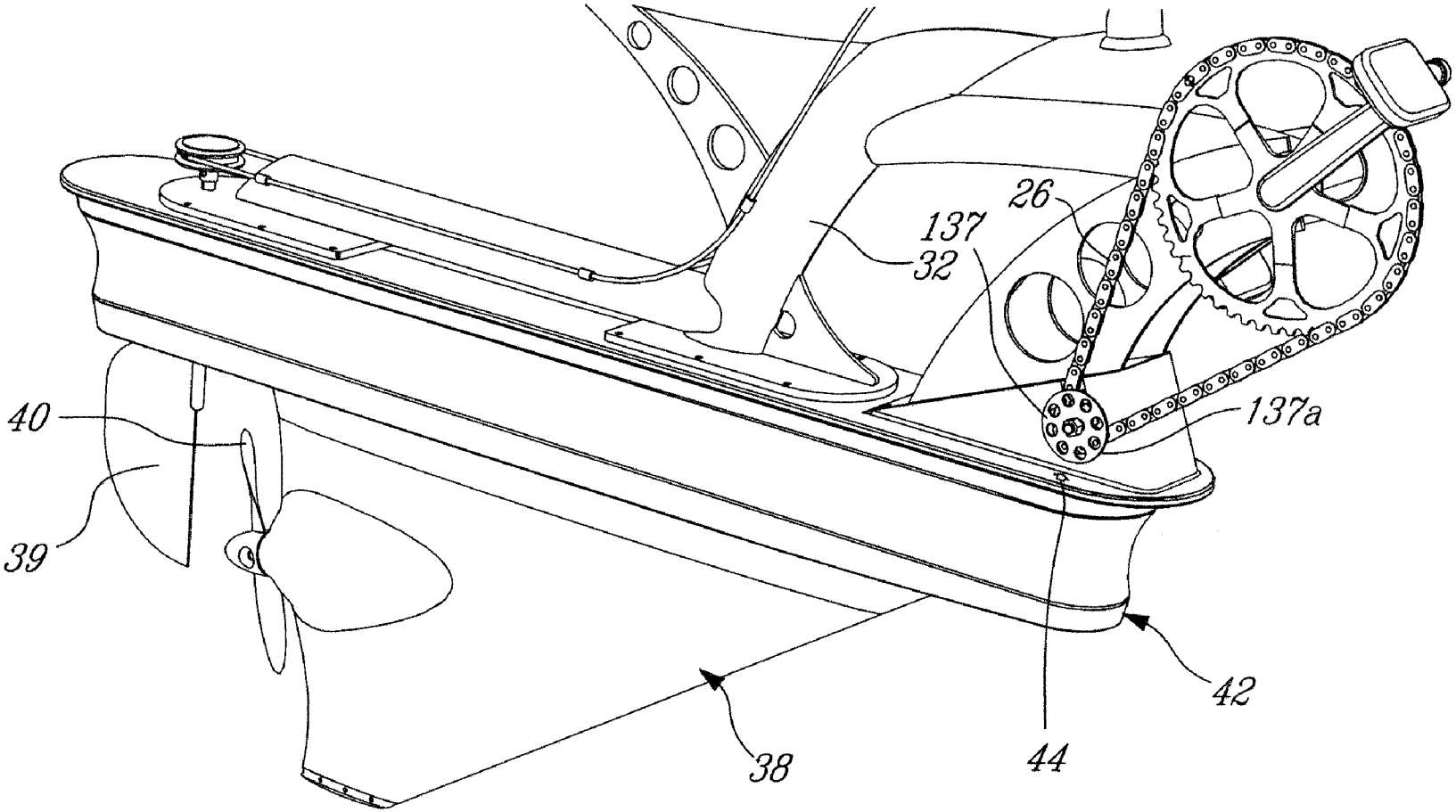
FIG. 6 is a partial perspective view of a further embodiment of a detail of the watercraft.

In another embodiment, as shown in FIG. 6, the sprocket 137 includes parallel sidewalls 137*a* to prevent the chain from derailing.

The embodiments of the invention described above are intended to be exemplary. Those skilled in the art will therefore appreciate that the forgoing description is illustrative only, and that various alternatives and modifications can be devised without departing from the spirit of the present invention. Accordingly, the present is intended to embrace all such alternatives, modifications and variances which fall within the scope of the appended claims.

We claim:

1. A personal watercraft comprising: a floatation platform, having a buoyancy and a lateral stability such that at least one person can be supported thereon, and a separate module including a water propulsor driving crank mechanism and a keel to which the water propulsor is mounted; the separate module mounted to the platform extends at right angles to the platform with the keel and a propeller of the water propulsor extending below the platform and the propulsor driving crank mechanism extending above the platform, and the separate module being separable from the platform for storage and transport; the floatation platform being a mono-hull defining an opening through which the separate module may be inserted and fastened to the platform, and the mono-hull including a longitudinal axis extending between a bow and a stern of the hull and a through-slot is defined in the mono-hull along the longitudinal axis while the separate module includes a beam portion between the keel and the bicycle frame that fits within the slot when the separate module is installed on the mono-hull.

2. The personal watercraft as defined in claim 1, wherein the propeller is a multi-vane propeller driven by a pedal crank mechanism and the separate module includes a support member for supporting the weight of a person operating the watercraft.

3. The personal watercraft as defined in claim 2, wherein the keel houses a propeller shaft and the separate module includes a bicycle frame mounting the pedal crank mechanism for driving the shaft and a seat for supporting the weight of the person, whereby the keel is integral with the remainder of the bicycle frame forming the separate module.

4. A watercraft comprising a floatation platform having a bow, a stern, port and starboard sides, the platform having a buoyancy and a lateral stability such that at least one person can be supported thereon and a bicycle frame, the platform defining a slot extending along a longitudinal axis extending between the bow and the stern; the bicycle frame having a beam portion which extends in the longitudinal axis between the bow and the stern and which extends through said slot in the platform when the bicycle frame is installed on the mono-hull while the bicycle frame being separable from the platform for storage and transport; and wherein the floatation platform is a mono-hull through which the slot extends along said longitudinal axis thereof and within which the beam portion of the bicycle frame is disposed when the bicycle frame is installed on the mono-hull.

5. The watercraft as defined in claim 4, wherein the mono-hull of the floatation platform is first module and the bicycle frame includes a keel adapted to extend below the hull and a propeller is operable mounted abaft the keel wherein the bicycle frame including the keel represent a second module wherein the first and second modules are separable for transport.

6. The watercraft as defined in claim 5, wherein the keel houses the propeller shaft and a pedal-mechanism for driving the shaft, and the keel is integral with the remainder of the bicycle frame forming the second module.

* * * * *